US005189623A

United States Patent [19]

Komuro et al.

[11] Patent Number: 5,189,623

[45] Date of Patent: Feb. 23, 1993

[54] EMBROIDERY DATA PROCESSING APPARATUS

[75] Inventors: Kyoji Komuro; Atsuya Hayakawa; Hideaki Shimizu, all of Nagoya, Japan

[73] Assignee: Brother Kogyo Kabushiki Kaisha, Nagoya, Japan

[21] Appl. No.: 604,881

[22] Filed: Oct. 26, 1990

[30] Foreign Application Priority Data

Oct. 31, 1989 [JP] Japan ..... 1-285515

[51] Int. Cl.[5] ..... G06F 15/46; D05B 21/00

[52] U.S. Cl. ..... 364/470; 112/121.12; 112/454

[58] Field of Search ..... 364/470, 188, 189, 191-193; 112/121.11, 121.12, 121.13, 266.1, 453-458, 103

[56] References Cited

U.S. PATENT DOCUMENTS

| | | | |
|---|---|---|---|
| 4,413,574 | 11/1983 | Hirota et al. | 112/121.12 |
| 4,943,906 | 7/1990 | Tauima et al. | 364/470 X |
| 4,991,524 | 2/1991 | Ozaki | 364/470 X |
| 4,998,489 | 3/1991 | Hisatake et al. | 364/470 X |

*Primary Examiner*—Joseph Ruggiero
*Attorney, Agent, or Firm*—Oliff & Berridge

[57] ABSTRACT

An apparatus for processing embroidery data utilized by a sewing machine for embroidering areas by filling the areas with stitches, including a storing device storing, for each of the area, sets of position data representative of defining points which cooperate with each other to define the each area, a selecting device selecting, based on the sets of position data for the areas, one of pairs of the defining points belonging to successive two of the areas one of which precedes the other area in an order of embroidering of the areas which pairs result from combining a particular defining point belonging to a first group consisting of the defining points defining one of the successive two areas, with each of defining points which belong to a second group consisting of the defining points defining the other of the successive two areas and which satisfy a predetermined requirement, such that a distance between the two defining points of the selected pair is the smallest of the pairs, and a determining device determining one of the two defining points of the selected pair which one point belongs to the preceding one of the successive two areas, as an end position of the embroidering of the preceding one area, and the other defining point of the selected pair as a start position of the embroidering of the other area of the successive two areas.

11 Claims, 5 Drawing Sheets

EMBROIDERY DATA PROCESSING APPARATUS

BACKGROUND OF THE INVENTION

1. Field of the Invention

The present invention generally relates to an embroidery data processing apparatus, and particularly to such an apparatus which processes embroidery data utilized by a sewing machine for embroidering a plurality of areas by filling the areas with stitches.

2. Related Art Statement

There is known a sewing machine which automatically embroiders an area defined by a plurality of points, by filling the area with stitches. The sewing machine embroiders the area by automatically displacing a work fabric on which the embroidery is formed, relative to a needle which is reciprocated vertically to form the stitches filling the area. The sewing machine is operated according to sets of stitch position data representative of stitch positions at which the sewing machine sticks the needle in the work fabric. Each set of stitch position data consists of the coordinate values of a corresponding stitch position in a coordinate system provided for a virtual plane parallel to the work fabric. There is also known an apparatus for processing embroidery data utilized by such a sewing machine for automatically embroidering an area. The embroidery data processed by the apparatus may be stitch position data as indicated above or, alternatively, stitch position-related data different from the stitch position data. The stitch position-related data is, for example, a combination of sets of position data representative of the points defining the area, and a set of stitch density data indicative of a density of stitches, i.e., number of stitches formed in unit area. While the sewing machine produces stitch position data by utilizing such stitch position-related data, it embroiders the area.

For embroidering an area, a start and an end position of the embroidering are specified. While it had conventionally been carried out by an operator to specify the embroidery start and end positions of an area, U.S. patent application Ser. No. 539,207 filed on Jun. 18, 1990, the assignee of which is the assignee of the present application, proposes an embroidery data processing apparatus which automatically specifies the embroidery start and end positions of an area. The apparatus specifies positions or points one by one on the outline of the area in one of clockwise or counterclockwise directions so that the specified points cooperate with each other to define the area or the outline thereof, and determines the first and last specified points of the defining points as the embroidery start and end positions of the area.

The above indicated apparatus determines the embroidery start and end positions of an area according to simple control program. However, in the case where two or more areas are embroidered in succession, the apparatus may specify inappropriate embroidery start and/or end positions for the areas. In order to embroider, for example, two successive areas with a continuous thread, the formation of a transfer stitch from the embroidery end position of the first (prior) one of the two successive areas to the embroidery start position of the second (subsequent) area is needed. Depending upon the embroidery end and start positions specified for the respective two successive areas, the length of the transfer stitch may adversely be increased. As the length of a transfer stitch is increased, a longer time is required for embroidering the areas. In addition, an unnecessary length of thread is consumed. Furthermore, if the transfer stitch passes outside the areas, the external appearance of the embroidery of the areas is deteriorated.

It is considered to automatically determine the most distant, or substantially the most distant, two of the points defining an area to be embroidered, as the embroidery start and end positions of the area. This manner is also subject to the above indicated problems.

SUMMARY OF THE INVENTION

It is therefore an object of the present invention to provide an embroidery data processing apparatus which automatically determines the embroidery start and end positions for a plurality of areas such that the length of a transfer stitch connecting between each pair of successive areas of the areas becomes as short as possible.

The above object has been achieved by the present invention, which provides an apparatus for processing embroidery data utilized by a sewing machine for embroidering a plurality of areas by filling the areas with stitches, comprising (a) storing means for storing, for each of the areas, sets of position data each of which is representative of a corresponding one of a plurality of defining points which cooperate with each other to define the each area, (b) selecting means for selecting, based on the sets of position data stored in the storing means, one of pairs of the defining points belonging to successive two of the areas one of which precedes the other area in an order of embroidering of the areas which pairs result from combining a particular defining point belonging to a first group consisting of the defining points defining one of the successive two areas, with each of defining points which belong to a second group consisting of the defining points defining the other of the successive two areas and which satisfy a predetermined requirement, such that a distance between the two defining points of the selected pair is the smallest of the pairs, and (c) determining means for determining one of the two defining points of the selected pair which one point belongs to the preceding one of the successive two areas, as an end position of the embroidering of the preceding one area, and the other defining point of the selected pair as a start position of the embroidering of the other area of the successive two areas.

In the embroidery data processing apparatus constructed as described above, the selecting means selects the pair of adjacent points such that a distance between the adjacent points of the selected pair is the smallest in the pairs, based on the sets of position data stored in the storing means, and the determining means determines one of the adjacent points of the selected pair as the embroidery end position of the first (prior) one of the two successive areas and the other adjacent point as the embroidery start position of the second (subsequent) one of the two areas. The pairs one of which is selected as the pair of adjacent points result from combining a particular defining point belonging to one of the two successive areas, and each of defining points belonging to the other of the two areas. The particular defining point may be one of the two defining points predetermined as the embroidery start and end positions. If the areas are embroidered according to the embroidery data produced by the present apparatus, the length of a transfer stitch connecting between each pair of successive areas of the areas is remarkably reduced. In addition, if the length of the transfer stitch is reduced, unnecessary length of thread is reduced and time required for the embroidering is minimized.

In a preferred embodiment of the present invention, the selecting means selects, as the selected pair, one of the pairs which result from combining each of the defining points belonging to the first group and each of the defining points belonging to the second group. In this case, the particular defining point is one of the two defining points of the selected pair, and therefore is not specified before the selection of the pair (i.e., pair of adjacent points). In addition, the defining points satisfying the predetermined requirement are all the defining points belonging to the second group. In this embodiment, the length of a transfer stitch connecting between the successive two areas is minimized. Even in the case where the two successive areas are spaced apart from each other, the length of the transfer stitch is reduced, thereby improving the external appearance of the embroidery of the areas.

According to another feature of the present invention, if the successive two areas partially overlap each other, the selecting means selects as the selected pair one of the pairs which result from combining the particular defining point, with each of defining points which belong to the second group and which satisfy the predetermined requirement of being located in the overlapping portion of the two areas. In this case, the defining points which belong to the second group and simultaneously are located in the overlapping portion of the two areas, satisfy the predetermined requirement. In this embodiment, one of the adjacent points of the selected pair is located in the overlapping portion of the two areas, a transfer stitch connecting between the adjacent points, i.e., the embroidery end position of the first one of the two areas and the embroidery start position of the second area does not pass outside the two areas with a high possibility. In contrast, if none of the adjacent points of the selected pair is located in the overlapping portion, as may be the case with the above indicated embodiment, a transfer stitch connecting between the adjacent points may pass outside the two areas. However, in the present embodiment, the length of a transfer stitch connecting between the two areas may become greater than the length of a transfer stitch provided in the above indicated embodiment.

According to a feature of the present invention, the selecting means determines, if the successive two areas partially overlap each other, a third group of the defining points which belong to the first group and which are located in the overlapping portion of the two areas, and a fourth group of the defining points which belong to the second group and which are located in the overlapping portion of the two areas, the selecting means selecting, as the selected pair, one of the pairs which result from combining each of the defining points of the third group and each of the defining points of the fourth group. In this case, since both the adjacent points of the selected pair are located in the overlapping portion of the two areas, a transfer path connecting between the adjacent points does not pass outside the areas or the stitches formed in the areas.

According to another feature of the present invention, the selecting means successively checks, if the successive two areas partially overlap each other, whether or not at least one of the two defining points of each of the pairs which result from combining each of the defining points belonging to the first group and each of the defining points belonging to the second group, is located in the overlapping portion of the two areas, in an order of distance between the two defining points of the each pair which order begins with one of the pairs which one pair consists of the nearest two defining points of all the pairs, the selecting means selecting, as the selected pair, one of the pairs for which an affirmative judgment is provided for a first time in the order of distance.

In yet another embodiment of the present invention, the apparatus further comprises means for specifying two of the defining points belonging to the each area, as a temporary embroidery start position and a temporary embroidery end position of the each area, respectively, the determining means determining the temporary embroidery start position of one of the areas which one area is an initial area in the order of embroidering of the areas, as a start position of the embroidering of all the areas, and the temporary embroidery end position of one of the areas which one area is a terminal area in the embroidering order, as an end position of the embroidering of all the areas.

In a further embodiment of the present invention, the apparatus further comprises means for producing special stitch data utilized by the sewing machine for forming special stitches different from the stitches filling the each area, one of the special stitches being formed at at least one of the embroidery start and end positions of the each area. Examples of the special stitches are stitches formed for bringing a continuous thread from the embroidery start position to another position in the each area, and stitches formed for fastening the thread at the embroidery end position of the each area. The stitches for fastening the thread may be formed at the embroidery start position. In the case where a transfer stitch connecting between the embroidery end position of the first one of the two successive areas and the embroidery start position of the second area, consists of a single stitch, special stitch data for forming the single transfer stitch is not needed. However, in the case where a transfer stitch consist of two or more stitches, it is necessary to produce special stitch data therefor. Such special stitch data may be produced by the present apparatus after the embroidery start and end positions are determined or, alternatively, by the sewing machine while the embroidery of the areas is carried out thereby.

According to another feature of the present invention, the apparatus further comprises means for dividing at least one of the areas into blocks arranged in an array, each of the blocks being filled with the stitches formed by the sewing machine. The apparatus may further comprise means for producing stitch position data representative of stitch positions where the sewing machine sticks a needle in an embroidery material for forming stitches and filling the each block with the formed stitches.

According to yet another feature of the present invention, the apparatus is constituted by a control device which controls operation of the sewing machine. The control device may include manually operable means for placing the control device in an embroidery start and end positions determine mode thereof, the control device operating for determining the embroidery start and end positions of the each area upon operation of the manually operable means.

BRIEF DESCRIPTION OF THE DRAWINGS

The above and optional objects, features and advantages of the present invention will be better understood by reading the following detailed description of the presently preferred embodiments of the invention when considered in conjunction with the accompanying drawings, in which.

DETAILED DESCRIPTION OF THE PREFERRED EMBODIMENT

Figure 1:
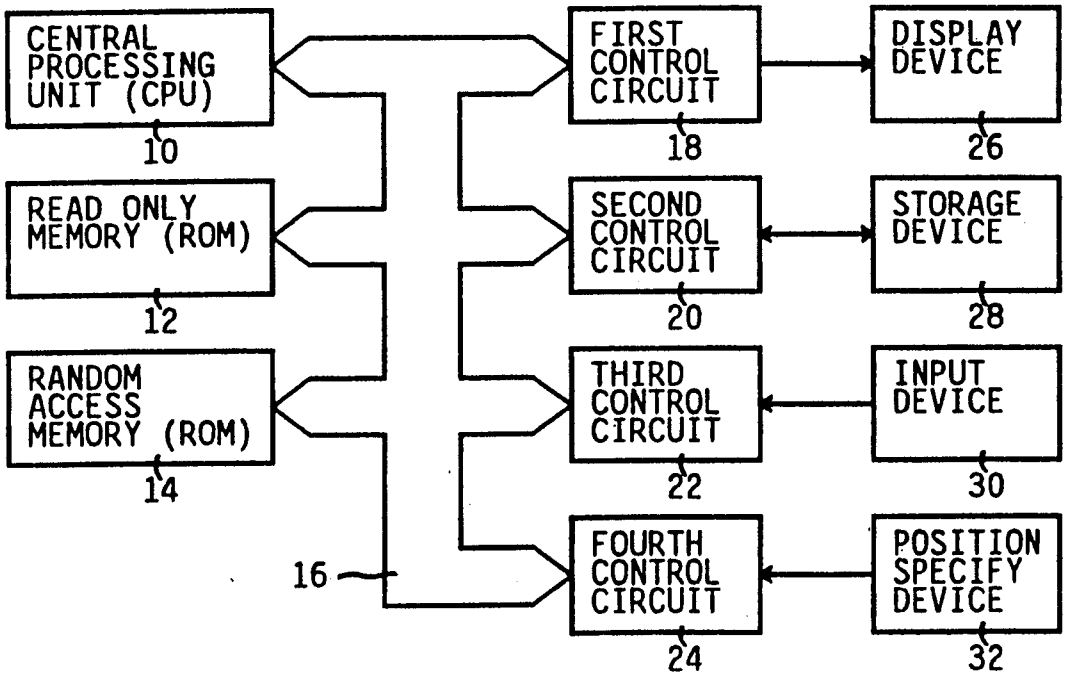
FIG. 1 is a diagrammatic view of an embroidery data processing apparatus embodying the present invention.

Referring first to FIG. 1, there is illustrated an embroidery data processing apparatus embodying the present invention. In the figure, reference numeral 10 designates a central processing unit (CPU) to which a read only memory (ROM) 12 and a random access memory (RAM) 14 are connected via a common bus (signal transmitting conductor) 16. Further, to the CPU 10, a display device 18, a storage device 20, an input device 30, and a position specify device 32 are connected via a first, a second, a third, and a fourth control circuit 18, 20, 22, 24, respectively.

Figure 2:
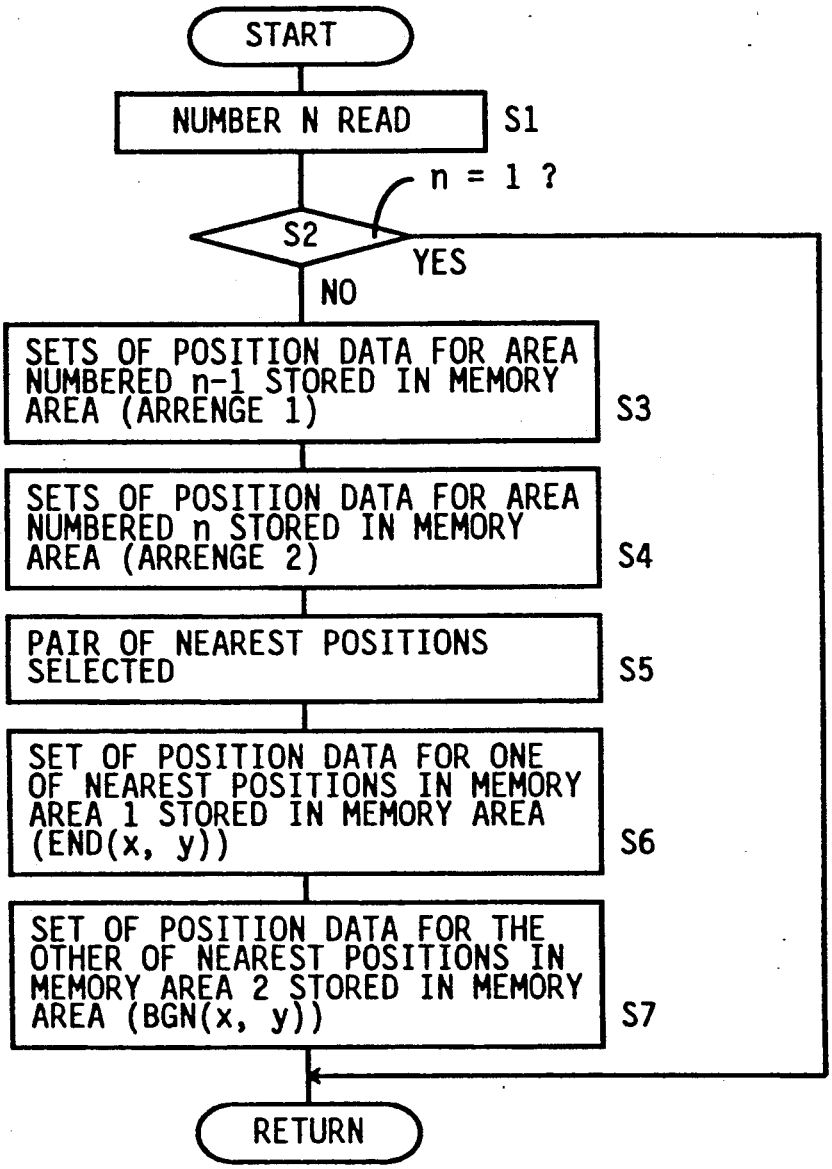
FIG. 2 is a flow chart representing a routine of the control programs stored in a read only memory (ROM) of the apparatus of FIG. 1 which routine is essential to the present invention.

The ROM 12 stores various control programs including an embroidery start and end positions determine routine represented by the flow chart of FIG. 2. The CPU 10 processes embroidery data according to the control programs stored in the ROM 12, while using coded data stored in the RAM 14 and storage device 28. The input device 30 includes a keyboard and an image pick-up device. The keyboard has a number of key switches which are operated by an operator for controlling the operation of the CPU 10. The image pick-up device, such as a television camera or an image sensor, takes or reads an image. The display device 26 includes a cathode ray tube (CRT) which displays the image read by the pick-up device of the input device 30. The position specify device 32 includes a light pen or a mouse which is used by the operator for specifying positions or points on the CRT display 26.

The present embroidery data processing apparatus may be connected to a control device which controls the operation of a sewing machine, or otherwise may be used as being an independent device separate from a sewing machine. In the latter case, the processed embroidery data is recorded once on a storage medium such as a floppy disk or a magnetic tape and, then, is read by a data read device provided for the sewing machine. The CPU 10, ROM 12, and RAM 14 may be constituted by a control device of a sewing machine.

Figure 3:
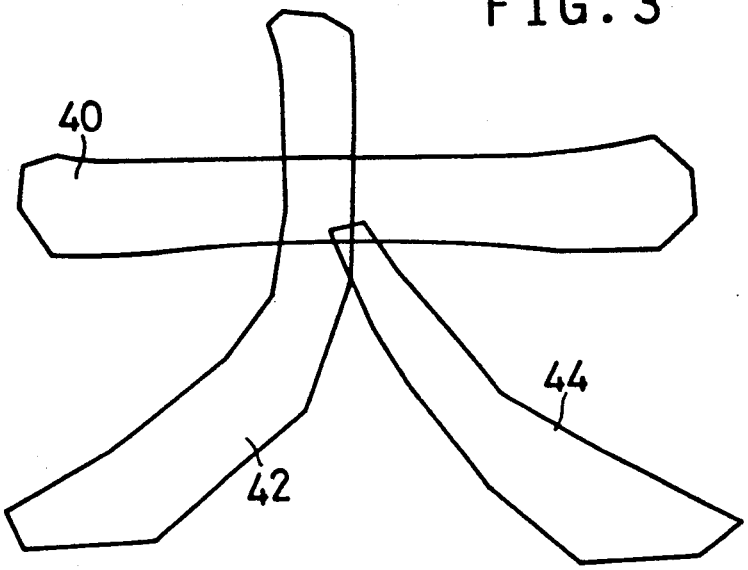
FIG. 3 is a view of areas, the apparatus of FIG. 1 processing embroidery data for embroidering the areas.

There will be described the operation of the present apparatus for processing a set of embroidery data utilized by a sewing machine for embroidering a Chinese character "大" as shown in FIG. 3, for example.

Initially, the operator operates the keyboard of the input device 30 for placing the CPU 10 in an image-read mode thereof, so that the image pick-up device of the input device 30 reads an image of the character "大" indicated on an original. A set of image data representative of the read image is prepared and stored in the RAM 14, and the image of the character "大" is displayed on the CRT display 26.

Subsequently, the keyboard is further operated for placing the CPU 10 in an area-specify mode thereof, so that the operator uses the position specify device 32 for specifying areas which correspond to elements or constituents of the character "大". Specifically, three areas 40, 42, 44 are specified as shown in FIG. 2. Each of the areas 40, 42, 44 is defined by the points specified by using the light pen 32 on the CRT display 26. Those defining points are indicated at symbols "●" (circle), "▲" (triangle), and "■" (quadrangle), in FIG. 4. Sets of position data representative of the defining points are prepared and stored in the RAM 14. Each set of position data consists of an X and a Y coordinate value of a corresponding defining point in an X-Y coordinate system provided for the CRT display 26. For each of the areas 40, 42, 44, first, the defining point 46 indicated at symbol "■" is specified (hereinafter, referred to as the initial point) and, then, the defining points 47 indicated at symbols "●" (hereinafter, referred to as the intermediate points) are specified and, last, the defining point 48 indicated at symbol "▲" (hereinafter, referred to as the terminal point) is specified, while following an outline (closed curve) of the each area 40, 42, 44 in a counterclockwise direction thereof.

The sets of position data for the defining points 46, 47, 48 of the areas 40, 42, 44 are stored in the RAM 14 such that the sets of position data are grouped into three groups corresponding to the areas 40, 42, 44, respectively, and each of the groups is provided with a set of additional data indicative of a corresponding number, n, assigned thereto. In this particular case, the areas 40, 42, 44 are specified in the order of description, and are provided with numbers, one, two, three, respectively. In addition, for each area 40, 42, 44, the initial and terminal points 46, 48 thereof are identified as temporary embroidery start and end positions thereof where the embroidering of the each area 40, 42, 44 is started and ended, respectively. The two sets of position data representative of the temporary start and end positions are stored in memory areas, BGN (x, y) and END (x, y), of the RAM 14, respectively. The sets of position data stored in the BGN (x, y) and END (x, y) memories for each of the areas 40, 42, 44, are another set of additional data for the group corresponding to the each area 40, 42, 44.

After the areas 40, 42, 44 are specified in this way, the keyboard is further operated for placing the CPU 10 in an embroidery start and end positions determine mode thereof, so as to execute the embroidery start and end positions determine routine represented by the flow chart of FIG. 2.

Initially, the control begins with Step S1 to read the number, n, assigned to the first group stored in the RAM 14. In this case, the number, one, assigned to the group corresponding to the area 40 is read. Step S1 is followed by Step S2 to judge whether or not the read number n is one. Since the read number n is one, an affirmative judgment is provided in Step S2, and the control returns without proceeding with Step S3 and the following steps. Thus, one cycle of the routine of FIG. 2 is ended.

In the next cycle, Steps S1 and S2 are executed for the group corresponding to the area 42. Since the number n assigned to the second group is two, a negative judgment is provided in Step S2, and the control goes to Steps S3 and S4. In Step S3, all sets of position data for the area numbered (n−1), i.e., area 40, are stored in a memory area, ARRANGE 1, of the RAM 14. In Step S4, all sets of position data for the area numbered n, i.e., area 42, are stored in a memory area, ARRANGE 2, of the RAM 14.

Step S4 is followed by Step S5 to select one of pairs of the defining points which pairs are obtained by combining each of the defining points represented by the sets of position data stored in ARRANGE 1, and each of the defining points represented by the sets of position data stored in ARRANGE 2, such that a distance between the two defining points of the selected pair is the smallest of all the pairs of the defining points. The selected pair is referred to as the pair. The pair of adjacent points for the two successive areas 40, 42 consist of the defining point 50 which is indicated at "▲" (triangle) in FIG. 5 and which belongs to the area 40, and the defining point 51 which is indicated at "■" (quadrangle) and which belongs to the area 42.

Subsequently, in Step S6, the set of position data for the defining point 50 of the area 40 is stored as a set of position data for the proper embroidery end position of the area 40 in the END (x, y) memory for the area 40 and, then, in Step S7, the set of position data for the defining point 51 of the area 42 is stored as a set of position data for the proper embroidery start position of the area 42 in the BGN (x, y) memory for the area 42. Thus, for the area 40, the set of position data for the terminal point 48 indicated at "▲" (triangle) in FIG. 4, i.e., temporary embroidery end position of the area 40 is replaced by the set of position data for the defining point 50 indicated at "▲" in FIG. 5. Similarly, for the area 42, the set of position data for the initial point 46 indicated at "■" (quadrangle) in FIG. 4, i.e., temporary embroidery start position of the area 42 is replaced by the set of position data for the defining point 51 indicated at "■" in FIG. 5.

Figure 4:
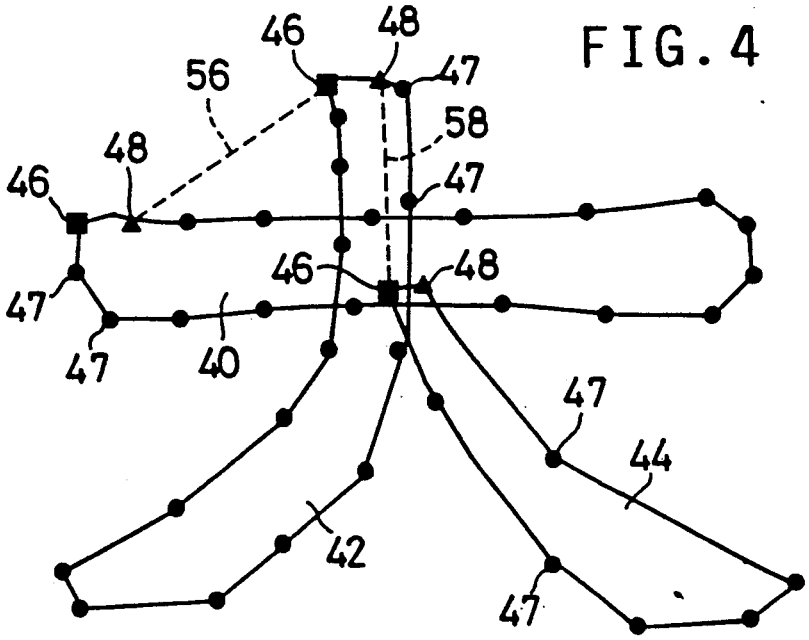
FIG. 4 is a view of points defining the areas and including temporary embroidery start and end positions of the areas.
Figure 5:
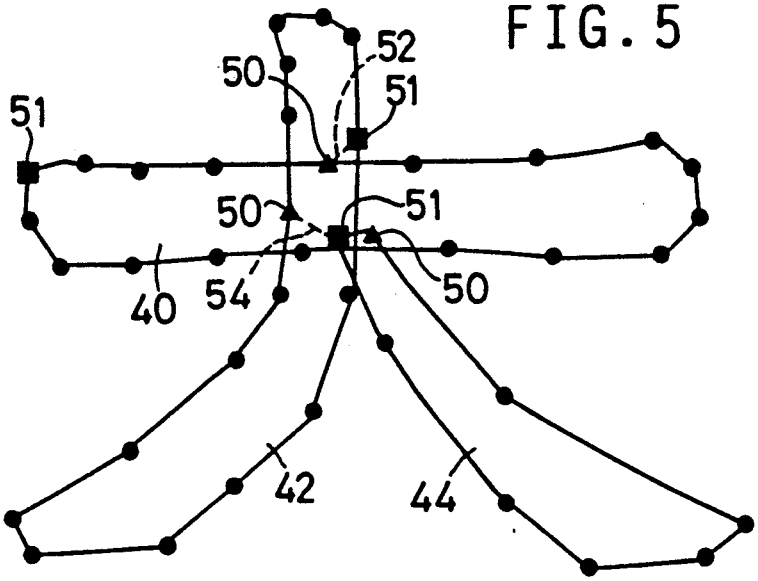
FIG. 5 is a view of the proper embroidery start and end positions of the areas.

In the next cycle, Steps S1 through S7 are executed for the two successive areas 42, 44, Consequently, the embroidery end position of the area 42 is changed from the terminal point 48 indicated at "▲" (triangle) in FIG. 4 to the defining point 50 indicated at "▲" in FIG. 5. However, the proper embroidery start position of the area 44 is identified at the first point 46 of the area 44 indicated at "■" (quadrangle) in FIG. 4, since the defining point 51 determined in Step S5 for the area 44 incidentally coincides with the initial point 46. The initial point 46 of the area 40 that is the initial area to be embroidered in the order of embroidering of the series of areas 40, 42, 44, is determined as the embroidery start position of the area 40 and simultaneously as an embroidery start position of the series of areas 40, 42, 44, while the terminal point 48 of the area 44 that is the terminal area in the embroidering order is determined as the embroidery end position of the area 44 and simultaneously as an embroidery end position of the series of areas 40, 42, 44.

As a result of changing the temporary start and end positions 46, 48 to the proper start and end positions 51, 50, a transfer stitch 56 from the area 40 to the area 42 and a transfer stitch 58 from the area 42 to the area 44, as indicated in broken lines in FIG. 4, are changed to a transfer stitch 52 and a transfer stitch 54, as indicated broken lines in FIG. 5, respectively. The transfer stitches 52, 54 are remarkably reduced in length as compared with the transfer stitches 56, 58, respectively.

In the present embodiment, the RAM 14 serves as storing means for storing sets of position data for the defining points, the CPU 10, ROM 12, and RAM 14 executing Step S5 of the flow chart of FIG. 2 serve as selecting means for selecting the pair of adjacent points, and the CPU 10, ROM 12, and RAM 14 executing Steps S6 and S7 serve as determining means for determining the embroidery start and end positions.

After the embroidery start and end positions 51, 50 of each of the areas 40, 42, 44 are determined in this way, the keyboard is operated for placing the CPU 10 in an area-divide mode thereof, so that each area is divided into simple blocks such as triangles and quadrangles. The division operation includes three steps. Those steps are disclosed in detail in a U.S. patent application filed by the Applicants and others, U.S. patent application Ser. No. 07/601,469, filed Oct. 23, 1990. Since the division operation is not essential to the present invention, only a brief description of the operation is provided, below.

Figure 6:
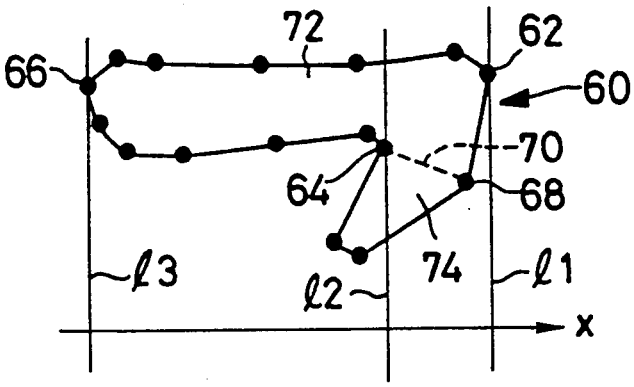
FIG. 6 is a view for explaining a first step of dividing an area into first sub-areas.

The first step of the division operation is such that, in the case where the outline of an area to be embroidered is bent or deflected like an area 60 shown in FIG. 6, the area is divided at the bent or deflected location thereof into two sub-areas. Whether or not the outline of an area is deflected is identified by successively checking the points defining the area, for an outward deflection point. Whether or not each of the defining points is a deflection point is identified by judging whether or not the two defining points adjacent to the each defining point, located on both sides thereof, are located on a common (single) side of a straight line which passes the each defining point and is perpendicular to the X axis of the X-Y coordinate system, where the area has been rotated so that a reference direction determined for the area becomes parallel to the X axis. The reference direction is defined as, for example, being the direction of a straight line passing the most distant, or substantially the most distant, two of all the defining points belonging to the area (hereinafter, referred to as the longitudinal direction). Regarding the example 60 of FIG. 6, lines, $l_1$, $l_2$, $l_3$, are the straight lines perpendicular to the X axis, and defining points 62, 64, 66 are the deflection points. In addition, whether or not each of the deflection points is an outward deflection point is identified by judging, in the case where the two adjacent defining points of the each deflection point on both sides thereof are checked on the outline of the area in a clockwise direction, the second (subsequent) one of the two adjacent defining points that follows the each deflection point in the clockwise direction is located on a left-hand side of a straight line passing the first (prior) one of the two adjacent defining points and the each deflection point and, in the case where the two adjacent defining points are checked in a counterclockwise direction, the second one of the two adjacent defining points is located on a right-hand side of the straight line passing the first one of the two adjacent defining points and the each deflection point. Regarding the example 60 of FIG. 6, the deflection point 64 is identified as an outward deflection point at which the outline of the area 60 is deflected outward.

The outward deflection point, e.g., defining point 64 for the area 60 of FIG. 6, is determined as a division base point. In addition, out of all the defining points that are located on a right-hand side of the straight line $l_2$ which side is opposite to the left-hand side where the two adjacent defining points of the division base point 64 are not located, the nearest defining point 68 to the division base point 64 is selected, and the selected defining point 68 is determined as a cooperative point which cooperates with the division base point 64 to define a straight division line (segment) 70 connecting the two points 64, 68. The area 60 is divided by the division line 70 into two sub-areas 72, 74.

Figure 7:
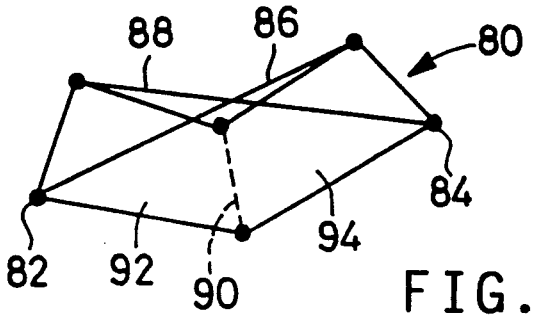
FIG. 7 is a view for explaining a second step of dividing an area or first sub-area into second sub-areas.

The second step of the division operation is such that, first, the most distant, or substantially the most distant, two of the points defining an area which may be the sub-area 72, 74 resulting from the first step, or an area which has not been divided in the first step, are determined and, if any one of straight segments obtained by connecting each of the two distant defining points and each of the other defining points of the area intersects the outline of the area or passes outside of the area, the area is divided into two sub-areas by a straight division line (segment). Regarding an area 80 shown in FIG. 7, defining points 82, 84 are determined as the most distant two defining points, and straight segments 86, 88 intersect the outline of the area 80. In this particular case, the area 80 is divided by a straight division line 90 into two sub-areas 92, 94.

Figure 8:
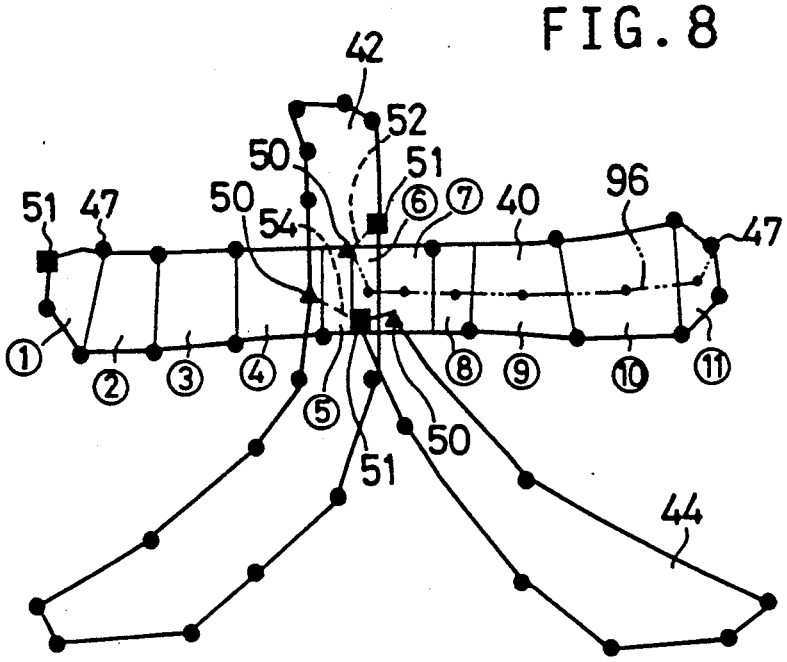
FIG. 8 is a view for explaining a third step of dividing an area, first sub-area, or second sub-area into blocks, and simultaneously explaining the stitch position data production based on the blocks.

The third step of the division operation is effected for an area or sub-area which by no means or no longer is divided by the first or second step. In this step, first, an area or a sub-area is divided into aid blocks by aid lines which are perpendicular to the longitudinal direction of the area or sub-area and each of which passes a corresponding one of the points defining the area, and then the direction of a central line of each of the aid blocks is determined. In addition, each of the aid lines is modified based on the directions of the central lines of the two blocks adjacent to the each aid line on both sides thereof, so that the direction of the modified aid line reflects the directions of those central lines. The modified aid lines serve as straight division lines (segments) for dividing the area into blocks based on which stitch position data is prepared. The thus produced blocks make in the area an array extending in the longitudinal direction thereof. FIG. 8 shows the area 40 divided into eleven blocks indicated at encircled numbers assigned thereto. As the direction of a central line of each aid block, an intermediate direction may be used between the directions of the two segments of the each aid block which segments are opposed to each other in a direction perpendicular to the longitudinal direction of the area. In this case, as the direction of one of the opposed two segments, the direction may be used of a first vector starting at one of both ends of the one segment and ending at the other end thereof, while as the direction of the other segment, the direction may be used of a second vector starting at one of both ends of the other segment which one end is opposed to the one end of the one segment and ending at the other end thereof which is opposed to the other end of the one segment. The intermediate direction between the directions of the opposed two segments may be the direction of a third vector obtained by addition of the first and second vectors. Alternatively, as the direction of one of the opposed two segments, the direction may be used of a first straight segment connecting between both ends of the one segment, while as the direction of the other segment, the direction may be used of a second straight segment connecting between both ends of the other segment. The intermediate direction may be the direction of a bisector of an angle contained by the first and second segments. Furthermore, as the direction of a central line of each aid block, the direction may be used of a straight segment connecting between the middle points of the respective two segments of the each aid block which segments are opposed to each other in the longitudinal direction of the area.

By the above described three steps of division operation, an area to be embroidered is divided into quadrangle-like blocks each defined by four points which may include one or more new points different from the points 46, 47, 48 specified by the operator on the CRT display 26. Based on those blocks, is prepared stitch position data utilized by a sewing machine for forming stitches in each of the blocks and filling the each block with the formed stitches, thereby embroidering the area. Regarding the area 40 of FIG. 8, first, stitch position data for the blocks numbered one, two, three, four, and five are prepared in the order of description, then is prepared stitch position data for forming stitches 96 along a generally straight connect path which passes the central position of each of the blocks numbered six, seven, eight, nine, ten, and eleven in the order of description and arrives at a defining point 47 belonging to the block numbered eleven, and further stitch position data is prepared for the blocks numbered eleven, ten, nine, eight, seven, and six in the order of description. Thus, the preparation of stitch position data for embroidering the area 40 beginning with the start position 51 and ending with the end position 50, is finished. According to the thus produced stitch position data, each of the blocks of the area is filled with stitches connecting between the opposed two segments of the each block which segments are opposed to each other in the direction perpendicular to the longitudinal direction of the area. The connect path 96 may be determined to follow the start position 51 as well as to connect between two blocks which are arranged in succession in the order of filling of the blocks. As the central position of each block, may be used the middle point of a straight segment connecting between the middle points of the respective two diagonals of the quadrangle-like each block. In addition, stitch position data for forming stitches for fastening a thread at the embroidery end position of an area, may be prepared.

Subsequently, stitch position data for forming the transfer stitch 52 from the end position 50 of the area 40 to the start position 51 of the area 42, is prepared, and then stitch position data for embroidering the area 42 is produced.

Upon completion of the stitch position data production for all the areas 40, 42, 44, the produced stitch position data is transmitted from the RAM 14 to the storage device 28. Thus, one time of stitch position data production is ended.

Regarding the three areas 40, 42, 44 constituting the character "大", those areas 40, 42, 44 partially overlap each other and simultaneously at least one of the end position 50 of the first (prior) one of each pair of successive areas, 40 and 42, 42 and 44, and the start position 51 of the second (subsequent) area is located in the overlapping portions of the two areas. Therefore, none of the transfer stitches 52 between the areas 40, 42 and between the areas 42, 44 pass outside the three areas 40, 42, 44, i.e., character "犬", as is apparent from FIG. 5.

In the meantime, in the case of embroidering a Chinese character "犬", an area corresponding to an element "丶" located at an upper and right-hand portion of the character do not overlap any portion of the remainder of the character. In this case, a transfer stitch between the area in question and the remainder of the character inevitably passes outside of the character. However, if the transfer stitch is formed according to the stitch position data prepared by the present apparatus, the length of the transfer stitch becomes remarkably short, improving external appearance of the embroidery of the character.

Figure 9:
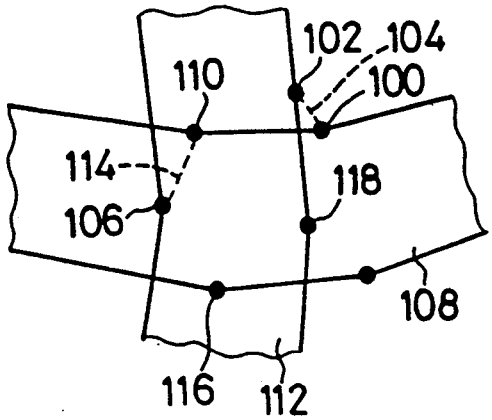
FIG. 9 is a view for explaining the selection by another embodiment of the present invention of a pair of adjacent points.

However, in the case where two successive areas partially overlap each other but neither the end position of the first one of the successive areas nor the start position of the second area is located in the overlapping portions of the two areas, a transfer stitch from the end position to the start position may pass outside the areas. A stitch 104 connecting between a defining point 100 belonging to an area 108 and a defining point 102 belonging to an area 112, shown in FIG. 9, is a transfer stitch passing outside of the two successive areas 108, 112. For the example of FIG. 9, if a defining point 110 is determined as the end position of the area 108 and a defining point 106 is determined as the start position of the area 112, a transfer stitch 114 from the end position 110 to the start position 106 does not pass outside the areas 108, 112.

While in Step S5 of FIG. 2 the pair consisting of the nearest two defining points are selected as the pair of adjacent points that are utilized as the end position of the first one of the two areas and the start position of the second area, it is possible to provide Step S5 with a requirement that, if two successive areas overlap each other, the two defining points of the pair of adjacent points must be ones located in the overlapping portions of the areas. In this case, a transfer stitch between the two successive areas overlapping each other does not pass outside the areas.

The defining points located in the overlapping portions of two successive areas, may be selected such that, first, five or so pairs respectively consisting of the nearest two defining points, the second nearest two points, the third nearest two points, the fourth nearest two points, the fifth nearest two points, . . . , are selected and, then, the defining points which belong to each one of the two areas and each of which is one of the two defining points of each of the selected pairs, are checked for a special defining point from which the two segments extend each of which intersects the outline (segment) of the other of the two areas. The thus found special defining point is determined as a defining point located in the overlapping portions of the two areas. Regarding the example of FIG. 9, defining points 116, 118 as well as the defining points 110, 106 satisfy the above indicated requirement. The defining points 110, 116 belonging to the area 108 are determined as a first group, while the defining points 106, 118 belonging to the area 112 are determined as a second group. One of pairs obtained by combining each of the defining points of the first group and each of the defining points of the second group, is selected such that a distance between the two defining points of the selected pair is the smallest of all the pairs. Regarding the example of FIG. 9, the pair of defining points 110, 106 are selected as the pair of adjacent points, and the defining point 110 is determined as the end position of the first area 108 while the defining point 106 is determined as the start position of the second area 112. Alternatively, in the case where two successive areas each have been divided into blocks by execution of the previously described third step, whether or not each of the defining points belonging to each one of the two areas is located in the overlapping portions of the areas, is identified by checking whether or not the X and Y coordinate values of the each defining point falls within any one of the blocks belonging to the other of the two areas.

It is practically found that, in the case where either one of the end and start positions is located in the overlapping portions of two successive areas, a transfer stitch connecting between the end and start positions does not pass outside the areas with a good possibility. For example, if the defining point 110 is determined as the end position of the area 108 while the defining point 102 that is not located in the overlapping portions of the areas 108, 112 is determined as the start position of the area 112, a transfer stitch connecting between the end and start points 110, 102 does not pass outside the areas 108, 112. Therefore, if a defining point located in the overlapping portions of two successive areas is found, the defining point is determined as a particular defining point and one of pairs obtained by combining the particular point and each of the defining points belonging to one of the two areas which one is different from the other area to which the particular defining point belongs is selected such that a distance between the two defining points of the selected pair is the smallest of all the pairs. A transfer stitch connecting between the two defining points of the selected pair does not pass outside the areas with a good possibility. Thus, it is important to find such a particular defining point that is located in the overlapping portions of two successive areas.

The pair of adjacent points the two defining points of which are located in the overlapping portions of two successive areas, may be determined such that, first, all the special defining points that are located in the overlapping portions are identified and, then, one of pairs obtained by each of the special defining points belonging to one of the two areas and each of the special defining points belonging to the other area is selected such that a distance between the two defining points of the selected pair is the smallest of all the pairs.

While the present invention has been described in its presently preferred embodiments, it is to be understood that the present invention by no means is limited to the details of the illustrated embodiments but may be embodied with various changes, improvements and modifications that may occur to those skilled in the art without departing from the scope and spirit of the invention defined in the appended claims.

What is claimed is:

1. An apparatus for processing embroidery data and utilizing the data for controlling a sewing machine for embroidering a plurality of areas by filling the areas with stitches, comprising:

storing means for storing, for each of said areas, sets of position data each of which is representative of a corresponding one of a plurality of defining points which cooperate with each other to define said each area;

selecting means for selecting, based on the sets of position data stored in said storing means, one of pairs of the defining points belonging to successive two of said areas one of which precedes the other area in an order of embroidering of said areas which pairs result from combining a particular defining point belonging to a first group consisting of the defining points defining one of said successive two areas, with each of defining points which belong to a second group consisting of the defining points defining the other of said successive two areas and which satisfy a predetermined requirement, such that a distance between the two defining points of the selected pair is the smallest of said pairs;

producing means for determining one of the two defining points of said selected pair which one point belongs to said preceding one of said successive two areas, as an end position of the embroidering of said preceding one area, and the other defining point of said selected pair as a start position of the embroidering of said other area of said successive two areas, and producing said embroidery data based on the determined end and start positions of said successive two areas; and data utilization means for using said embroidery data to form said stitches.

2. The apparatus as set forth in claim 1, wherein said selecting means selects, as said selected pair, one of said pairs which result from combining each of the defining points belonging to said first group and each of the defining points belonging to said second group, said particular defining point being one of the two defining points of said selected pair, said defining points satisfying said predetermined requirement being all the defining points belonging to said second group.

3. The apparatus as set forth in claim 1, wherein, if said successive two areas partially overlap each other, said selecting means selects as said selected pair one of said pairs which result from combining said particular defining point, with each of defining points which belong to said second group and which satisfy said predetermined requirement of being located in the overlapping portion of said two areas.

4. The apparatus as set forth in claim 3, wherein said selecting means determines, if said successive two areas partially overlap each other, a third group of the defining points which belong to said first group and which are located in the overlapping portion of said two areas, and a fourth group of the defining points which belong to said second group and which are located in the overlapping portion of said two areas, said selecting means selecting, as said selected pair, one of said pairs which result from combining each of the defining points of said third group and each of the defining points of said fourth group.

5. The apparatus as set forth in claim 3, wherein said selecting means successively checks, if said successive two areas partially overlap each other, whether or not at least one of the two defining points of each of said pairs which result from combining each of the defining points belonging to said first group and each of the defining points belonging to said second group, is located in the overlapping portion of said two areas, in an order of distance between the two defining points of said each pair which order begins with one of said pairs which one pair consists of the nearest two defining points of all said pairs, said selecting means selecting, as said selected pair, one of said pairs for which an affirmative judgment is provided for a first time in said order of distance.

6. The apparatus as set forth in claim 1, wherein said producing means comprises means for specifying two of the defining points belonging to said each area, as a temporary embroidery start position and a temporary embroidery end position of said each area, respectively, said producing means determining said temporary embroidery start position of one of said areas which one area is an initial area in said order of embroidering of said areas, as a start position of the embroidering of all said areas, and said temporary embroidery end position of one of said areas which one area is a terminal area in said embroidering order, as an end position of the embroidering of all said areas.

7. The apparatus as set forth in claim 1, wherein said producing means comprises means for producing special stitch data, said data utilization means utilizing said special stitch data for forming special stitches different from the stitches filling said each area, one of said special stitches being formed at at least one of the embroidery start and end positions of said each area, examples of said special stitches being stitches formed for bringing a continuous thread from said embroidery start position to another position in said each area, and stitches formed for fastening said thread at said embroidery end position of said each area.

8. The apparatus as set forth in claim 1, wherein said producing means comprises means for dividing at least one of said areas into blocks arranged in an array, each of said blocks being filled with the stitches formed by said sewing machine.

9. The apparatus as set forth in claim 8, wherein said producing means comprises means for producing as said embroidery data stitch position data representative of stitch positions where said sewing machine sticks a needle in an embroidery material for forming stitches and filling said each block with the formed stitches.

10. The apparatus as set forth in claim 1, wherein the apparatus is constituted by a control device which controls operation of said sewing machine.

11. The apparatus as set forth in claim 10, wherein said control device includes manually operable means for placing said control device in an embroidery start and end positions determine mode thereof, said control device operating for determining said embroidery start and end positions of said each area upon operation of said manually operable means.

* * * * *